US009401106B2

(12) United States Patent
Choi

(10) Patent No.: US 9,401,106 B2
(45) Date of Patent: Jul. 26, 2016

(54) COLOR COMPENSATION DEVICE AND DISPLAY DEVICE USING THE SAME, AND COLOR COMPENSATION METHOD

(71) Applicant: Samsung Display Co., Ltd., Yongin, Gyeonggi-Do (KR)

(72) Inventor: Yong-Seok Choi, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 42 days.

(21) Appl. No.: 14/297,463

(22) Filed: Jun. 5, 2014

(65) Prior Publication Data

US 2015/0054864 A1 Feb. 26, 2015

(30) Foreign Application Priority Data

Aug. 22, 2013 (KR) ..... 10-2013-0099806

(51) Int. Cl.

| | |
|---|---|
| ***G09G 3/20*** | (2006.01) |
| ***G09G 3/32*** | (2016.01) |
| ***G09G 3/00*** | (2006.01) |
| ***G09G 5/00*** | (2006.01) |

(52) U.S. Cl.

CPC ..... *G09G 3/2003* (2013.01); *G09G 3/006* (2013.01); *G09G 3/3208* (2013.01); *G09G 5/005* (2013.01); *G09G 2300/0452* (2013.01); *G09G 2320/0276* (2013.01); *G09G 2320/0666* (2013.01); *G09G 2340/06* (2013.01)

(58) Field of Classification Search

CPC ..... G09G 5/02; G09G 2340/06; G09G 2320/0666; G09G 3/2003; G09G 5/06; G09G 2300/0452; G09G 2320/0242; G09G 2340/02

See application file for complete search history.

(56) References Cited

U.S. PATENT DOCUMENTS

| | | | | |
|---|---|---|---|---|
| 6,750,874 | B1 * | 6/2004 | Kim | G09G 3/3413 345/600 |
| 2004/0113875 | A1 * | 6/2004 | Miller | G09G 3/3216 345/82 |
| 2004/0222999 | A1 * | 11/2004 | Choi | G09G 3/3225 345/589 |
| 2009/0046307 | A1 * | 2/2009 | Kwak | G09G 5/02 358/1.9 |
| 2012/0194565 | A1 * | 8/2012 | White | G09J 3/2003 345/690 |

FOREIGN PATENT DOCUMENTS

| | | | |
|---|---|---|---|
| KR | 10-2009-0130045 | A | 12/2009 |
| KR | 10-2011-0061947 | A | 6/2011 |
| KR | 10-2012-0054458 | A | 5/2012 |

* cited by examiner

*Primary Examiner* — Olga Merkoulova

(74) *Attorney, Agent, or Firm* — Knobbe, Martens, Olson & Bear, LLP

(57) ABSTRACT

A color compensation method is disclosed. In one aspect, the method includes predetermining target color coordinates, measuring luminance and chromaticity from an image displayed on a display panel, and calculating compensation color coordinates by using the target color coordinates and the device color coordinates. The method also includes generating compensation data by using the target color coordinates, the device color coordinates, and the compensation color coordinates, receiving an external video signal, and converting the RGB data of the external video signal into the RGB data of the compensation color coordinates by using the compensation data corresponding to the RGB data of the external video signal. The compensation color coordinates are determined according to the values of the target color coordinates and the device color coordinates.

20 Claims, 4 Drawing Sheets

COLOR COMPENSATION DEVICE AND DISPLAY DEVICE USING THE SAME, AND COLOR COMPENSATION METHOD

CROSS-REFERENCE TO RELATED APPLICATIONS

This application claims priority to and the benefit of Korean Patent Application No. 10-2013-0099806 filed in the Korean Intellectual Property Office on Aug. 22, 2013, the entire contents of which are incorporated herein by reference.

BACKGROUND

1. Field

The described technology generally relates to a color compensation device, a display device including the same, and a color compensation method.

2. Description of the Related Technology

Display devices generally include a display area including a plurality of pixels arranged in a matrix. Each pixel is connected to scan lines and data lines to selectively apply data signals to the pixels, so as to display images.

Display devices can be categorized into passive matrix and active matrix light-emitting display devices according to their driving method. Active matrix light-emitting display devices are more common.

These display devices can be used in personal computers, mobile phones, portable information terminals such as PDAs, etc., or as a monitor for various information devices.

Examples of display technologies include liquid crystal displays (LCDs), organic light-emitting diode (OLED) displays, plasma display panels (PDPs), etc. OLED displays have been attracting attention due to their unique characteristics such as high luminous efficiency, preferable luminance and viewing angles, and quick response speeds.

SUMMARY OF CERTAIN INVENTIVE ASPECTS

One inventive aspect is a method of realizing target white color coordinates in a display device including a display panel in which pixels for a plurality of colors are arranged.

Another aspect is a display device and a color compensation method realizing image reproduction without an additional white color control device.

Another aspect is color compensation method including predetermining target color coordinates, measuring luminance and chromaticity from an image displayed on a display panel to calculate device color coordinates of the panel, calculating compensation color coordinates by using the target color coordinates and the device color coordinates, generating compensation data by using the target color coordinates, the device color coordinates, and the compensation color coordinates, receiving an external video signal, and converting the RGB (combined red/green/blue color) data of the external video signal into the RGB data of the compensation color coordinates by using the compensation data corresponding to the RGB data of the external video signal, wherein the compensation color coordinates are determined according to the value of the target color coordinates and the device color coordinates.

The display panel may include a plurality of RGBW (combined red/green/blue/white color) pixels.

The device color coordinates may include white color coordinates displayed by the W pixel.

The calculating of the compensation color coordinates may include comparing the value of the device color coordinates and the value of the target color coordinates and subtracting the difference between the value of the device color coordinates and the value of the target color coordinates from the value of the target color coordinates, if the value of the device color coordinates is greater than that of the target color coordinates.

The calculating of the compensation color coordinate may include adding the difference between the value of the device color coordinates and the value of target color coordinates to the value of the target color coordinates if the value of the device color coordinates is less than that of the target color coordinates.

The calculating of the compensation color coordinate may include setting the compensation color coordinates as the value of the target color coordinates if the value of the device color coordinates and the value of the target color coordinates are substantially equal.

The compensation data may be data that is used when the RGB data is converted into the XYZ (tristimulus values) data by using the compensation color coordinates and the target color coordinate, and the XYZ data is converted into the RGB data of the compensation color coordinate by using the device color coordinate.

Another aspect is a color compensation device including a storing unit storing predetermined target color coordinates and compensation data, a processor calculating device color coordinates of a display panel, calculating compensation color coordinates by using the target color coordinates and the device color coordinates, and generating the compensation data by using the target color coordinates, the device coordinates, and the compensation color coordinates, a compensation color gamut mapping calculating unit receiving an external video signal, and converting the RGB data of the external video signal into the RGB data of the compensation color coordinates by using the compensation data corresponding to the RGB data of the external video signal, and a data converter converting the RGB data of the compensation color coordinates into the RGBW data, wherein the compensation color coordinates are determined according to the value of the target color coordinates and the device color coordinates.

The device color coordinates may include white color coordinates displayed by a W pixel.

The value of the device color coordinates and the value of the target color coordinates may be compared, and if the value of the device color coordinates is greater than that of the target color coordinates, the compensation color coordinates may be calculated by subtracting the difference between the value of the device color coordinates and the value of the target color coordinates from the value of the target color coordinates.

If the value of the device color coordinates is less than that of the target color coordinates, the compensation color coordinates may be calculated as by adding the difference between the value of the device color coordinates and the value of the target color coordinates to the value of the target color coordinates.

If the value of the device color coordinates and the value of the target color coordinates are substantially equal to each other, the compensation color coordinates may be calculated as the value of the target color coordinates.

The converting the RGB data of the external video signal to the RGB data of the compensation color coordinates includes converting the RGB data into XYZ data by using the compensation color coordinates and the target color coordinates, and converting the XYZ data into the RGB data of the compensation color coordinates by using the device color coordinates.

Another aspect is a display device including a display panel including a plurality of RGBW pixels emitting light according to plurality of data signals supplied through data lines, and a controller receiving and driving an external video signal for a plurality of data signals to be supplied to the display unit, wherein the controller may include a storing unit storing predetermined target color coordinates and compensation data, and a processor calculating device color coordinates of the display panel by using measured luminance and chromaticity of an image displayed on the display panel, calculating compensation color coordinates by using the target color coordinates and the device color coordinates, and generating the compensation data by using the target color coordinates, the device coordinates, and the compensation color coordinates, a compensation color gamut mapping calculating unit receiving an external video signal and compensating the RGB data of the external video signal into the RGB data of the compensation color coordinates by using the compensation data corresponding to the RGB data of the external video signal, and a data converter converting the RGB data of the compensation color coordinates into the RGBW data.

The device color coordinate may include white color coordinates displayed by a W pixel.

The value of the device color coordinates and the value of the target color coordinates may be compared, and if the value of the device color coordinates is greater than that of the target color coordinates, the compensation color coordinates are calculated by subtracting the difference between the value of the device color coordinates and the value of the target color coordinates from the value of the target color coordinates.

If the value of the device color coordinates is less than that of the target color coordinates, the compensation color coordinates may be calculated by adding the difference between the value of the device color coordinates and the value of the target color coordinates to the value of the target color coordinates.

If the value of the device color coordinates and the value of the target color coordinates are substantially equal to each other, the compensation color coordinates may be calculated as the value of the target color coordinates.

The compensation data may be data that is used when the RGB data is converted into the XYZ data by using the compensation color coordinates and the target color coordinates, and the XYZ data is converted into the RGB data of the compensation color coordinates by using the device color coordinates.

Another aspect is a method of color compensation in a display device, the method including predetermining target color coordinates for a display panel, determining device color coordinates of the display panel, calculating compensation color coordinates based at least in part on the target color coordinates and the device color coordinates, generating compensation data based at least in part on the target color coordinates, the device color coordinates, and the compensation color coordinates, receiving an external video signal including combined red/green/blue color (RGB) data, and converting the RGB data of the external video signal into RGB data of the compensation color coordinates based at least in part on the compensation data.

The calculating may include subtracting the difference between a value of the device color coordinates and a value of the target color coordinates from the value of the target color coordinates when the value of the device color coordinates is greater than that of the target color coordinates.

According to at least one embodiment, the target white color coordinates may be correctly realized in the display device including the display panel arranged with the pixels for each color and clear images may be realized.

Also, a color compensation method that is capable of reproducing images and the display device using the same may be provided without an additional white color adjustment device while equally maintaining the color coordinates desired by the user.

BRIEF DESCRIPTION OF THE DRAWINGS

The accompanying drawings, which are included to provide a further understanding of the described technology, illustrate exemplary embodiments, and together with the description, serve to explain the principles of the described technology.

DETAILED DESCRIPTION OF CERTAIN INVENTIVE EMBODIMENTS

Figure 1:
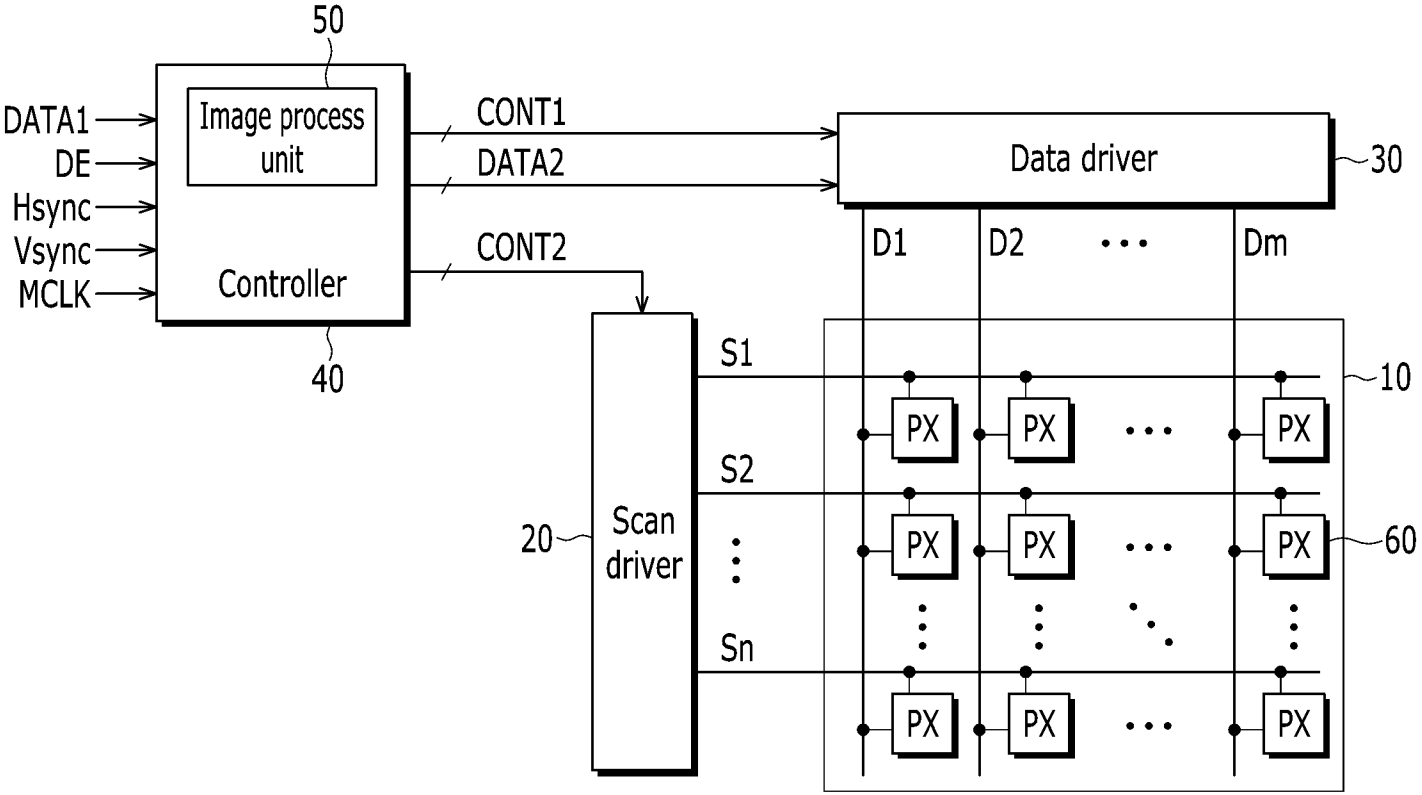
FIG. 1 is a block diagram illustrating the configuration of a display device according to an exemplary embodiment.

Each pixel of the standard OLED display emits light to display an image according to a driving current which depends on an input image signal.

In each pixel, the OLED includes an organic emission layer interposed between two driving electrodes.

The pixels can be arranged according to the color of light emitted from the pixels. For example the pixels can be arranged as red, green, blue, and white pixels. However, the image quality and color reproducibility of the OLED display may be negatively impacted due to a difference between the color coordinates of the displayed image and target color coordinates.

Particularly, it is difficult to apply conventional color gamut mapping to a method of realizing a white target image due to the structural arrangement of the pixels for each color in a display panel.

Hereinafter, exemplary embodiments of the described technology will be described with reference to the accompanying drawings so that those skilled in the art will be able to readily implement them. As those skilled in the art would realize, the described embodiments may be modified in various different ways, all without departing from the spirit or scope of the described technology.

In order to clearly characterize the described technology, portions thereof that are not connected with the description will be omitted, and the same elements or equivalents are referred to by the same reference numerals throughout the specification.

Throughout this specification and the claims that follow, when it is described that an element is "connected" to another element, the element may be "directly connected" to the other element or "electrically connected" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a block diagram illustrating the configuration of a display device according to an exemplary embodiment.

Referring to FIG. 1, a display device includes a display unit (or display panel) 10 in which a plurality of pixels 60 are arranged in a substantially matrix form, a scan driver 20 connected to the display unit 10, a data driver 30 connected to the display unit 10, and a controller 40 controlling the scan driver 20 and the data driver 30 and processing an external image signal.

The display unit 10 includes a plurality of scan lines S1-Sn connected to the scan driver 20, a plurality of data lines D1-Dm connected to the data driver 30, and a plurality of voltage lines (not shown) applying a power source voltage for driving the pixels 60.

The pixels 60 are respectively selected in response to a scan signal transmitted from a corresponding scan line. Also, activated pixels 60 emit light according to a data voltage which depends on a data signal received from corresponding data lines, thereby displaying an image. The data signal applied to the pixels 60 is an image data signal processed through color compensation according to an exemplary embodiment.

In the display device according to the present embodiment, each of the pixels 60 includes a pixel circuit including a switching transistor capable of activating the pixel 60 in response to the corresponding scan signal, a driving transistor generating a driving current with the data voltage according to the corresponding data signal and applying the driving current to the OLED, and an OLED emitting light with a luminance according to the driving current. However, the described technology is not limited to the configuration of the above described pixel circuit.

The OLED may emit light with one of primary colors or a white color.

An example of the primary colors includes three primary colors such as red, green, and blue. Desired colors are displayed as a spatial sum of the three primary colors. If white light is added to the displayed colors, the overall luminance increases.

In the display unit 10, the arrangement of the pixels 60 is not limited to a specific configuration. For example, red, green, blue, and white pixels can be arranged in a unit dot of a 2×2 matrix and the unit dot may be repeated and disposed in a row direction or a column direction. The matrix format of the pixels 60 of the display unit 10 may have a stripe structure or a pentile structure or may also have a checked arrangement structure of the unit dot, as shown in the example.

The pixels 60 emit light of each color in the OLED and the OLED has a structure in which the light is emitted in an organic emission layer interposed between an anode and a cathode.

The organic emission layer of the OLED may be formed of a low polymer organic material or a high polymer organic material such as poly(3,4-ethylenedioxythiophene) (PEDOT). Also, the organic emission layer may be formed of a multilayer including an emission layer and at least one of a hole injection layer (HIL), a hole transport layer (HTL), an electron transport layer (ETL), and an electron injection layer (EIL). In the case where all of the layers are included, the hole injection layer (HIL) is disposed on the pixel electrode which is the anode, and the hole transport layer (HTL), the emission layer, the electron transport layer (ETL), and the electron injection layer (EIL) are sequentially laminated thereon.

The organic emission layer may include a red, green, or blue organic emission layer respectively emitting red, green, or blue light and the emission layers are respectively formed in red, green, and blue pixels, thereby realizing a color image.

According to some embodiments, a white organic emission layer is formed in the organic emission layer or a pixel and include a configuration that may emit white by stacking a plurality of organic emission layers. For example, the white organic emission layer may include a combination of at least one of each of yellow and blue organic emission layers, a combination of at least one of each of cyan and red organic emission layers, or a combination of at least one of each of magenta and green organic emission layers.

On the other hand, according to some embodiments, the organic emission layer includes a stack of red, green, and blue organic emission layers for each of the red, green, blue and white pixels. In these cases, the pixels 60 include red, green and blue color filters except for in the white pixel, thereby realizing a color image.

According to some embodiments, a white organic emission layer which emits white light is formed in each of the red, green, blue and white pixels, and red, green, and blue color filters are respectively formed for each pixel to implement color images. In these cases, deposition masks for depositing the red, green, and blue organic emission layers for the respectively colored pixels 60 are not used.

On the other hand, in the display device of FIG. 1, the scan driver 20 generates and applies a plurality of scan signals to the scan lines S1-Sn connected to each pixel 60 of the display unit 10. The scan signals are a combination of a pulse voltage capable of turning on the switching transistor included in the pixels 60 and a pulse voltage capable of turning it off. For example, the scan driver 20 can sequentially apply the scan signals of the turn-on voltage to the scan lines for each line of the pixels 60 to sequentially activate the pixels 60.

Also, the data driver 30 of FIG. 1 applies the data voltage corresponding to an image data signal DATA2 to the data lines D1-Dm connected to each pixel 60 of the display unit. The image data signal DATA2 is generated by processing an external video signal DATA1 according to a color compensation method. The color compensation method and a processing method will be described in detail below, with reference to the following drawings.

The controller 40 generates and applies a driving control signal controlling the operations of the scan driver 20 and the data driver 30 to each driver. That is, a data driving control signal CONT1 controlling the operation of the data driver 30 may be generated and applied to the data driver 30 and a scan driving control signal CONT2 controlling the operations of the scan driver 20 may be generated and applied to the scan driver 20.

The input control signals received by the controller 40 may include a vertical synchronization signal Vsync, a horizontal synchronization signal Hsync, a main clock signal MCLK, and a data enable signal DE.

The controller 40 receives the external video signal DATA1 to generate the image data signal DATA2 by processing with the color compensation method and the controller 40 applies the image data signal DATA2 to the data driver 30.

The controller 40 includes an image processing unit 50 to compensate the color. The image processing unit 50 may generate the compensation image data signal DATA2 by using compensation color coordinate data for the external video signal DATA1.

Next, the configuration and operations of the image processing unit 50 will be described with reference to FIG. 2.

Figure 2:
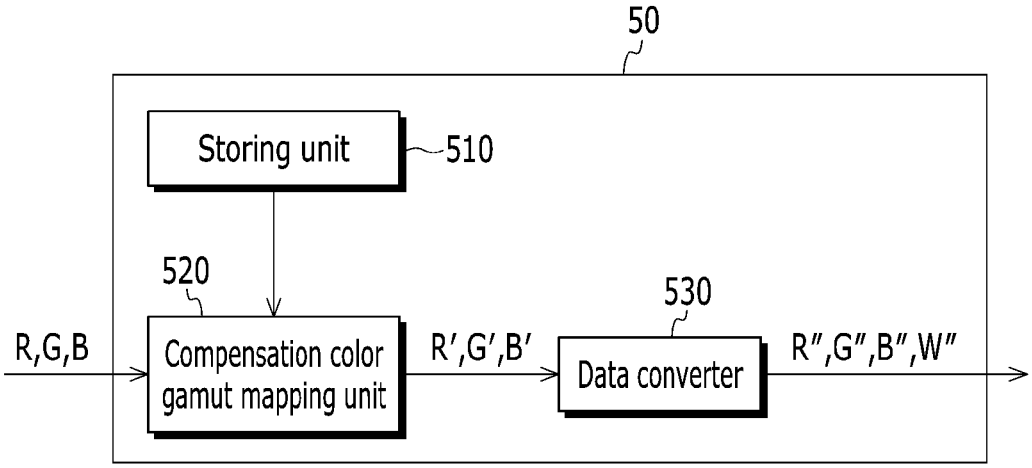
FIG. 2 is a block diagram illustrating the configuration of a color compensation device included in the controller of the display device of FIG. 1.

FIG. 2 is a block diagram illustrating the configuration of a color compensation device included in the controller of the display device of FIG. 1. As described, the image processing unit may include a storing unit (or memory) 510, a compensation color gamut mapping unit 520, and a data converter 530. According to some embodiments, the image processing unit 50 further includes a processor (not shown) which calculates compensation data.

Firstly, the storing unit 510 may store compensation data to compensate the RGB data of the external video signal DATA1 and may output the compensation data to the compensation color gamut mapping unit 520. The process of calculating the compensation data stored in the storing unit 510 will be described with reference to FIG. 3.

Figure 3:
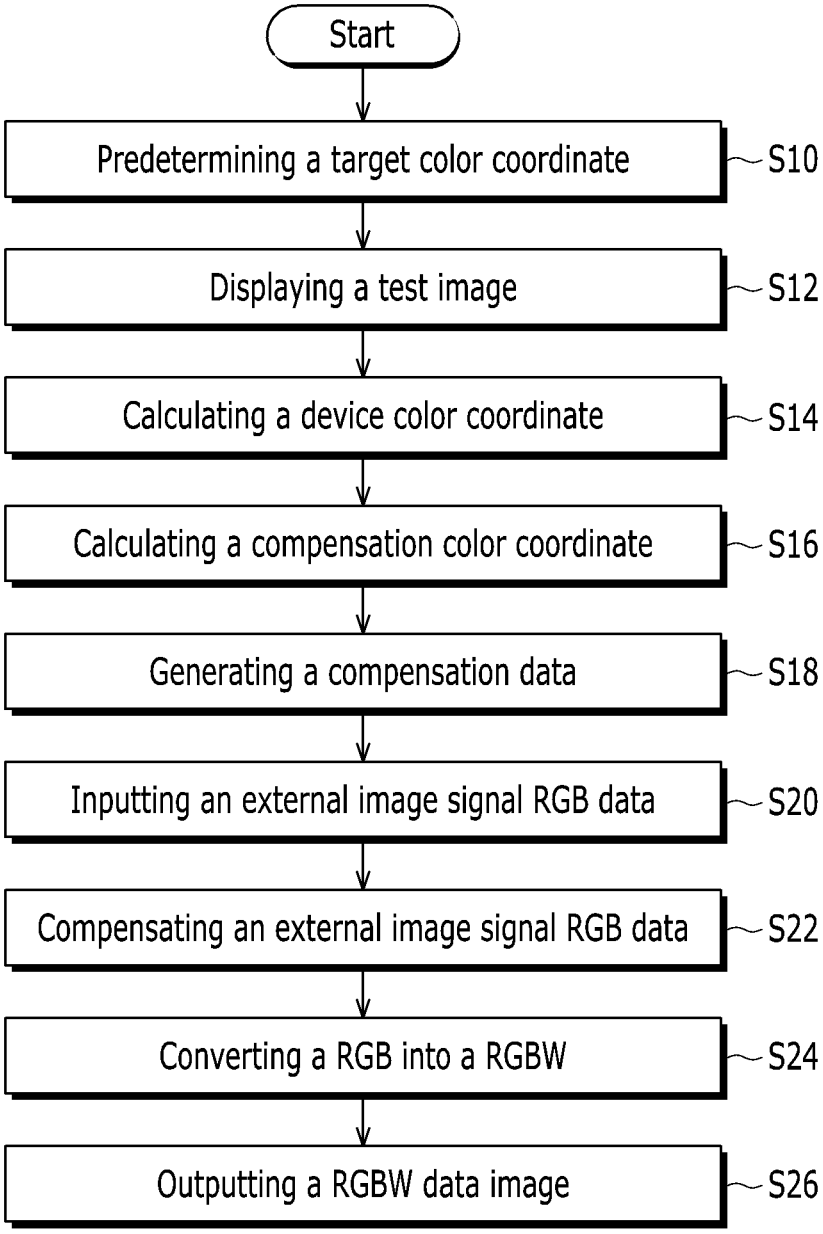
FIG. 3 is a flowchart illustrating a color compensation method according to an exemplary embodiment.

FIG. 3 is a flowchart illustrating a method of calculating compensation data for processing in a color compensation method according to an exemplary embodiment. Firstly, target color coordinates according to a standard color gamut of general video content, that is, a color gamut (sRGB, Adobe RGB, etc.,) to be targeted is predetermined (S10).

R, G, B, and W of the target color coordinates are assumed to be RGB format data of the D65 sRGB color gamut having values between 0 and 255. Thus, x and y of the target color coordinates are as shown in Table 1.

TABLE 1

| Color | R | G | B | Brightness ratio | x1 | y1 |
|---|---|---|---|---|---|---|
| Red | 255 | 0 | 0 | 21.3000 | 0.6400 | 0.3300 |
| Green | 0 | 255 | 0 | 71.5000 | 0.3000 | 0.6000 |
| Blue | 0 | 0 | 255 | 7.2000 | 0.1500 | 0.0600 |
| White | 255 | 255 | 255 | 100.0000 | 0.3130 | 0.3290 |

Also, a test image is displayed on the display unit 10 (S12). For example, the images of the R, G, and B grayscales of (255, 0, 0), (0, 255, 0), (0, 0, 255), and (255, 255, 255) may be displayed.

Next, luminance and chromaticity are measured from the test image displayed on the display unit 10 to calculate the device color coordinates (S14). The device color coordinates may be calculated during a process of producing and testing the display device.

That is, the color coordinates are calculated from the RGBW image displayed on the display unit 10 thereby generating the device color coordinate data. The device color coordinate data may be generated as shown in Table 2. At this time, a white color coordinate of a W pixel of RGBW may also be calculated.

TABLE 2

| Color | R | G | B | Brightness | x2 | y2 |
|---|---|---|---|---|---|---|
| Red | 255 | 0 | 0 | 125.2000 | 0.6644 | 0.3347 |
| Green | 0 | 255 | 0 | 289.6333 | 0.2172 | 0.7240 |
| Blue | 0 | 0 | 255 | 30.4267 | 0.1420 | 0.0463 |
| White | 255 | 255 | 255 | 361.9000 | 0.2893 | 0.3083 |

Further, compensation color coordinates are calculated by using the target color coordinates and the device color coordinates (S16). To calculate the compensation color coordinates, Equations 1 to 6 may be used.

$$Rx_W = Tx_W + |Tx_W - Px_W| \quad \text{Equation 1}$$

In Equation 1, RxW is the x value of the compensation white color coordinates, TxW is the x value of the target white color coordinates, and PxW is the x value of the device white color coordinates of the white pixel. For example, TxW may have the value of x1 when RGB of the target color coordinates is (255, 255, 255). PxW is the white color coordinate value of the white pixel calculated in S16.

Equation 1 may be used when TxW is greater than PxW.

$$Rx_W = Tx_W - |Tx_W - Px_W| \quad \text{Equation 2}$$

Equation 2 may be used when $T_{xW}$ is less than $P_{xW}$ $$Rx_W = Tx_W \quad \text{Equation 3}$$

Equation 3 may be used when $T_{xW}$ is substantially the same as $P_{xW}$.

$$Ry_W = Ty_W + |Ty_W - Py_W| \quad \text{Equation 4}$$

$R_{yW}$ is the y value of the compensation white color coordinates, $T_{yW}$ is the y value of the target white color coordinates, and $P_{yW}$ is the y value of the device white color coordinates of the white pixel. Equation 4 may be used when $T_{yW}$ is greater than $P_{yw}$. For example, $T_{yW}$ may have the value of y1 when the RGB of the target color coordinates is (255, 255, 255). $P_{yW}$ may be the white color coordinate value of the white pixel calculated in S16.

$$Ry_W = Ty_W - |Ty_W - Py_W| \quad \text{Equation 5}$$

Equation 5 may be used when $T_{yW}$ is less than $P_{yW}$.

$$Ry_W = Ty_W \quad \text{Equation 6}$$

Equation 6 may be used when $T_{yW}$ and $P_{yW}$ are substantially equal to each other.

Next, by using the target color coordinates, the device color coordinates, and the compensation white color coordinates, compensation data used to change the RGB data of the input external video signal into the RGB data of the compensation color coordinates is generated (S18).

Firstly, the RGB data of the input external video signal may be converted into XYZ data by using the compensation color coordinates.

$$\begin{bmatrix} K_{R1} \\ K_{G1} \\ K_{B1} \end{bmatrix} = \begin{bmatrix} X_{R1} & X_{G1} & X_{B1} \\ Y_{R1} & Y_{G1} & Y_{B1} \\ Z_{R1} & Z_{G1} & Z_{B1} \end{bmatrix}^{-1} \times \begin{bmatrix} \frac{x_{W1}}{y_{W1}} \\ 1 \\ \frac{z_{W1}}{y_{W1}} \end{bmatrix} = \frac{1}{y_{W1}} \times \begin{bmatrix} x_{R1} & x_{G1} & x_{B1} \\ y_{R1} & y_{G1} & y_{B1} \\ z_{R1} & z_{G1} & z_{B1} \end{bmatrix}^{-1} \times \begin{bmatrix} x_{W1} \\ y_{W1} \\ z_{W1} \end{bmatrix} \quad \text{Equation 7}$$

$K_{R1}$, $K_{G1}$, and $K_{B1}$ are compensation constants used to calculate the compensation color coordinates, $x_{R1}$, $x_{G1}$, $x_{B1}$, $y_{R1}$, $y_{G1}$, and $y_{B1}$ are the x and y values of the target color coordinates, and $x_{W1}$ and $y_{W1}$ are $R_{xW}$ and $R_{yW}$ values of the compensation white color coordinates. Further, the z values may be respectively calculated by using Equation 8.

$$z = 1 - x - y \quad \text{Equation 8}$$

Next, the RGB data of the external video signal may be converted into the XYZ data through Equation 9.

$$\begin{bmatrix} X1 \\ Y1 \\ Z1 \end{bmatrix} = \begin{bmatrix} x_{R1} & x_{G1} & x_{B1} \\ y_{R1} & y_{G1} & y_{B1} \\ z_{R1} & z_{G1} & z_{B1} \end{bmatrix}^{-1} \times \begin{bmatrix} K_{R1} & 0 & 0 \\ 0 & K_{G1} & 0 \\ 0 & 0 & K_{B1} \end{bmatrix} \begin{bmatrix} R1 \\ G1 \\ B1 \end{bmatrix} \quad \text{Equation 9}$$

Alternatively, by using the device color coordinates, Equation 10 may be used to convert the XYZ data into the RGB value of the device color coordinates.

$$\begin{bmatrix} K_{R2} \\ K_{G2} \\ K_{B2} \end{bmatrix} = \begin{bmatrix} x_{R2} & x_{G2} & x_{B2} \\ y_{R2} & y_{G2} & y_{B2} \\ z_{R2} & z_{G2} & z_{B2} \end{bmatrix}^{-1} \times \begin{bmatrix} \frac{x_{W2}}{y_{W2}} \\ 1 \\ \frac{z_{W2}}{y_{W2}} \end{bmatrix} = \frac{1}{y_{W2}} \times \begin{bmatrix} x_{R2} & x_{G2} & x_{B2} \\ y_{R2} & y_{G2} & y_{B2} \\ z_{R2} & z_{G2} & z_{B2} \end{bmatrix}^{-1} \times \begin{bmatrix} x_{W2} \\ y_{W2} \\ z_{W2} \end{bmatrix} \quad \text{Equation 10}$$

$K_{R2}$, $K_{G2}$, and $K_{B2}$ are device constants used to calculate the device color coordinates, $x_{R2}$, $x_{G2}$, $x_{B2}$, $y_{R2}$, $y_{G2}$, and $y_{B2}$ are the x and y values of the device color coordinate data RGB, and $x_{w2}$ and $y_{w2}$ are $P_{xW}$ and $P_{yW}$. Further, the z value may be respectively calculated by using Equation 8.

Thus, the XYZ (X2, Y2, Z2) and the RGB (R2, G2, B2) of the device color coordinates may be represented as in Equation 12.

$$\begin{bmatrix} X2 \\ Y2 \\ Z2 \end{bmatrix} = \begin{bmatrix} x_{R2} & x_{G2} & x_{B2} \\ y_{R2} & y_{G2} & y_{B2} \\ z_{R2} & z_{G2} & z_{B2} \end{bmatrix}^{-1} \times \begin{bmatrix} K_{R2} & 0 & 0 \\ 0 & K_{G2} & 0 \\ 0 & 0 & K_{B2} \end{bmatrix} \begin{bmatrix} R2 \\ G2 \\ B2 \end{bmatrix} \quad \text{Equation 11}$$

To convert the XYZ (X2, Y2, Z2) into the RGB (R2, G2, B2) of the device color coordinates, Equation 11 may be modified to generate Equation 12.

$$\begin{bmatrix} R2 \\ G2 \\ B2 \end{bmatrix} = \begin{bmatrix} K_{R2} & 0 & 0 \\ 0 & K_{G2} & 0 \\ 0 & 0 & K_{B2} \end{bmatrix}^{-1} \times \begin{bmatrix} x_{R2} & x_{G2} & x_{B2} \\ y_{R2} & y_{G2} & y_{B2} \\ z_{R2} & z_{G2} & z_{B2} \end{bmatrix}^{-1} \times \begin{bmatrix} X2 \\ Y2 \\ Z2 \end{bmatrix} \quad \text{Equation 12}$$

Also, X1, Y1, and Z1 of Equation 9 may be substituted to respectively correspond to X2, Y2, and Z2. Thus, the RGB of the external video signal may be converted into RGB on the device color coordinates.

$$\begin{bmatrix} R2 \\ G2 \\ B2 \end{bmatrix} = \begin{bmatrix} K_{R2} & 0 & 0 \\ 0 & K_{G2} & 0 \\ 0 & 0 & K_{B2} \end{bmatrix}^{-1} \times \begin{bmatrix} x_{R2} & x_{G2} & x_{B2} \\ y_{R2} & y_{G2} & y_{B2} \\ z_{R2} & z_{G2} & z_{B2} \end{bmatrix}^{-1} \times \begin{bmatrix} x_{R1} & x_{G1} & x_{B1} \\ y_{R1} & y_{G1} & y_{B1} \\ z_{R1} & z_{G1} & z_{B1} \end{bmatrix}^{-1} \times \begin{bmatrix} K_{R1} & 0 & 0 \\ 0 & K_{G1} & 0 \\ 0 & 0 & K_{B1} \end{bmatrix} \begin{bmatrix} R1 \\ G1 \\ B1 \end{bmatrix} \quad \text{Equation 13}$$

Thus, by using Equation 13, the compensation color gamut mapping unit 520 may convert the RGB data of the input external video signal into the RGB data of the compensation color coordinates.

Next, the RGB data of the external video signal is input (S20).

The compensation color gamut mapping unit 520 compensates the RGB data of the external video signal by using the compensation data corresponding to the RGB data of the external video signal (S22). In detail, the compensation data may have a plurality of divided values according to the grayscale of the white color coordinates. The storing unit 510 may output the compensation data corresponding to the grayscale of the white color coordinates of the RGB data of the external video signal that is input to the image processing unit 50 to the compensation color gamut mapping unit 520.

Thus, the compensation color gamut mapping unit 520 may compensate the RGB data of the external video signal by using the compensation data corresponding to the external video signal.

Next, the data converter 530 converts the converted RGB into RGBW by changing the relative brightness ratio of RGB and W according to chroma (S24). For example, when the chroma is high, the RGB may be converted to be output as it is, however, when the chroma is low, the RGB may be converted for the relative brightness ratio of W and RGB to be output as 1:1 and for the relative brightness ratio of RGBW that is converted for the RGB of the external video signal to be output as 0.5:0.5.

In detail, if the RGB converted into the compensation color coordinates respectively has the grayscales of 255, 255, and 255, the RGBW may be converted to respectively have the grayscales of 187, 187, 187, and 187. If the RGB converted into the compensation color coordinates has the grayscales of 255, 0, and 0, the RGBW may be output to have the grayscales of 255, 0, and 0.

Next, the data converted into the RGBW is output as the image (S26). The RGBW may be 8 bit data and may be output to the data driver 30 to be displayed on the display unit 10.

It is not necessary for the above-described steps S10 to S18 and S20 to S26 to be continuously performed. Steps S20 to S26 may be performed when inputting the external video signal after generating the compensation data through steps S10 to S18.

Figure 4:
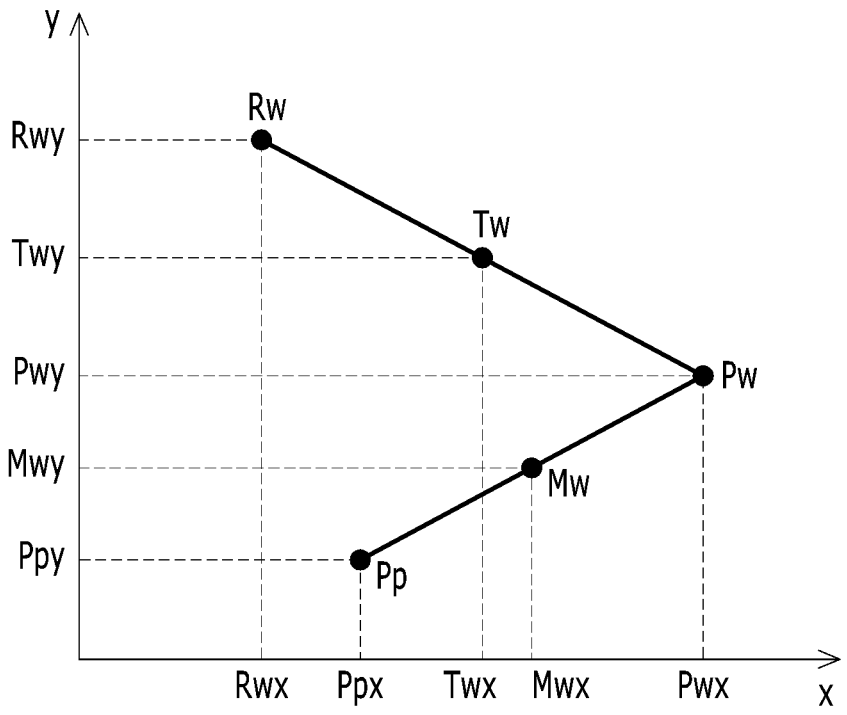
FIG. 4 is a graph showing a compensation effect in the case of applying a color compensation method according to an exemplary embodiment.

FIG. 4 is a graph showing a compensation effect in the case of applying a color compensation method according to an exemplary embodiment.

$P_W$ represents the white color coordinates of the W pixel measured in the display unit 10, $P_P$ represents the white color coordinates of the RGB pixel measured in the display unit 10, and $M_W$ represents the white color coordinates of the RGBW pixel measured in the display unit 10.

Also, $T_W$ represents the target white color coordinates and $R_W$ represents the white color coordinates of the RGB pixel compensated by the described technology.

By employing the color compensation method according to at least one embodiment, the white color coordinates ($P_P$) of the RGB pixel displayed on the display unit 10 may be compensated into $R_W$. Accordingly, the white color coordinates displayed by the RGB pixel of the display unit 10 by the color compensation method and the white color coordinates displayed by the W pixel are mixed, thereby displaying the target white color coordinates.

What is claimed is:

1. A color compensation method for a display device, comprising:

predetermining target color coordinates;

displaying a test image including grayscales corresponding to the target color coordinates on a display panel of the display device;

measuring luminance and chromaticity from the test image;

calculating device color coordinates of the display panel based at least in part on the measured luminance and chromaticity;

calculating compensation color coordinates based at least in part on a value of the target color coordinates and a value of the device color coordinates;

generating compensation data based at least in part on the target color coordinates, the device color coordinates, and the compensation color coordinates;

receiving an external video signal including combined red/green/blue color (RGB) data; and converting the RGB data of the external video signal into RGB data of the compensation color coordinates based at least in part on the compensation data corresponding to the RGB data of the external video signal.

2. The method of claim 1, wherein the display panel includes a plurality of combined red/green/blue/white color (RGBW) pixels.

3. The method of claim 2, wherein the device color coordinates include white color coordinates displayed by the W pixel.

4. The method of claim 1, wherein the calculating of the compensation color coordinates includes:

comparing the value of the device color coordinates and the value of the target color coordinates; and subtracting the difference between the value of the device color coordinates and the value of the target color coordinates from the value of the target color coordinate when the value of the device color coordinates is greater than that of the target color coordinates.

5. The method of claim 1, wherein the converting comprises:

converting the RGB data of the external video signal to tristimulus values (XYZ) data based at least in part on the compensation color coordinates and the target color coordinate; and converting the XYZ data into the RGB data of the compensation color coordinates based at least in part on the device color coordinates.

6. A color compensation device, comprising:

a memory storing predetermined target color coordinates and compensation data for a display panel;

a processor configured to: calculate device color coordinates of the display panel based at least in part on measured luminance and chromaticity of a test image including grayscales corresponding to the target color coordinates displayed on the display panel, ii) calculate compensation color coordinates based at least in part on a value of the target color coordinates and a value of the device color coordinates, and iii) generate the compensation data based at least in part on the target color coordinates, the device coordinates, and the compensation color coordinates;

a compensation color gamut mapping calculating unit configured to: i) receive an external video signal including combined red/green/blue color (RGB) data and ii) convert the RGB data of the external video signal into RGB data of the compensation color coordinates based at least in part on the compensation data corresponding to the RGB data of the external video signal; and a data converter configured to convert the RGB data of the compensation color coordinates into combined red/green/blue/white color (RGBW) data.

7. The color compensation device of claim 6, wherein the device color coordinates include white color coordinates displayed by a (RGBW) pixel.

8. The color compensation device of claim 7, wherein the processor is, to calculate the compensation color coordinates, configured to:

compare the value of the device color coordinates and the value of the target color coordinates; and subtract the difference between the value of the device color coordinates and the value of the target color coordinates from the value of the target color coordinates when the value of the device color coordinates is greater than that of the target color coordinates.

9. The color compensation device of claim 8, wherein the processor is further configured to add the difference between the value of the device color coordinates and the value of the target color coordinates to the value of the target color coordinates when the value of the device color coordinates is less than that of the target color coordinates.

10. The color compensation device of claim 9, wherein the processor is further configured to set the compensation color coordinates as the value of the target color coordinates when the value of the device color coordinates is substantially equal to that of the target color coordinates.

11. The color compensation device of claim 10, wherein the compensation color gamut mapping calculating unit is configured to:

convert the RGB data of the external video signal to tristimulus values (XYZ) data based at least in part on the compensation color coordinates and the target color coordinates; and convert the XYZ data into the RGB data of the compensation color coordinates based at least in part on the device color coordinates.

12. A display device, comprising:

a display panel including a plurality of combined red/green/blue/white color (RGBW) pixels; and a controller configured to i) receive an external video signal and ii) drive the display panel based at least in part on the received external video signal, wherein the controller includes:

a memory storing predetermined target color coordinates and compensation data;

a processor configured to: i) calculate device color coordinates of the display panel based at least in part on measured luminance and chromaticity of a test image including grayscales corresponding to the target color coordinates displayed on the display panel, ii) calculate compensation color coordinates based at least in part on the target color coordinates and the device color coordinates, and iii) generate the compensation data based at least in part on the target color coordinates, the device coordinates, and the compensation color coordinates;

a compensation color gamut mapping calculating unit configured to: i) receive an external video signal including combined red/green/blue color (RGB) data and ii) convert the RGB data of the external video signal into RGB data of the compensation color coordinates based at least in part on the compensation data corresponding to the RGB data of the external video signal; and a data converter configured to convert the RGB data of the compensation color coordinates into RGBW data.

13. The display device of claim 12, wherein the device color coordinate includes white color coordinates displayed by a W pixel.

14. The display device of claim 13, wherein the processor is configured to calculate the compensation color coordinates by:

comparing the value of the device color coordinates and the value of the target color coordinates; and subtracting the difference between the value of the device color coordinates and the value of the target color coordinates from the value of the target color coordinates when the value of the device color coordinates is greater than that of the target color coordinates.

15. The display device of claim 14, wherein the processor is configured to add the difference between the value of the device color coordinates and the value of the target color coordinates to the value of the target color coordinates when the value of the device color coordinates is less than that of the target color coordinates.

16. The display device of claim 15, wherein the processor is configured to set the compensation color coordinates as the value of the target color coordinates when the value of the device color coordinates is substantially equal to that of the target color coordinates.

17. The display device of claim 16, wherein the compensation color gamut mapping calculating unit is configured to:

convert the RGB data of the external video signal to tristimulus values (XYZ) data based at least in part on the compensation color coordinates and the target color coordinates; and convert the XYZ data into the RGB data of the compensation color coordinates based at least in part on the device color coordinates.

18. The display device of claim 12, wherein the display device comprises an organic light-emitting diode (OLED) display.

19. A method of color compensation in a display device, the method comprising:

predetermining target color coordinates for a display panel of the display device;

displaying a test image including grayscales corresponding to the target color coordinates on the display panel;

measuring luminance and chromaticity from the test image;

determining device color coordinates of the display panel based at least in part on the measured luminance and chromaticity;

calculating compensation color coordinates based at least in part on the target color coordinates and the device color coordinates;

generating compensation data based at least in part on the target color coordinates, the device color coordinates, and the compensation color coordinates;

receiving an external video signal including combined red/green/blue color (RGB) data; and converting the RGB data of the external video signal into RGB data of the compensation color coordinates based at least in part on the compensation data.

20. The method of claim 19, wherein the calculating comprises subtracting the difference between a value of the device color coordinates and a value of the target color coordinates from the value of the target color coordinates when the value of the device color coordinates is greater than that of the target color coordinates.

* * * * *